United States Patent [19]

Bertrand et al.

[11] Patent Number: 4,849,083

[45] Date of Patent: Jul. 18, 1989

[54] ROTARY CONDUCTOR ROLL FOR CONTINUOUSLY ELECTROPLATING METAL STRIP OR OTHER ELECTRICALLY CONDUCTIVE STRIP

[75] Inventors: Gilbert Bertrand, Thionville; Gérard Colin, Plappeville; Gérard Cottet, Mions; Guy Dupoyet, Genas; Pierre Gasperment, Hagondange; André Klein, Homecourt; Georges Michel, Villeurbanne; Jean-Marc Truchot, Lyons, all of France

[73] Assignees: Sollac; Gerland Stowe Woodward, both of France

[21] Appl. No.: 215,229

[22] Filed: Jul. 5, 1988

[30] Foreign Application Priority Data

Jul. 7, 1987 [FR] France ..... 87 09651

[51] Int. Cl.[4] ..... C25D 17/00

[52] U.S. Cl. ..... 204/206

[58] Field of Search ..... 204/206, 279

[56] References Cited

U.S. PATENT DOCUMENTS 3,483,113 12/1969 Carter ..... 204/206
3,634,223 1/1972 Carter ..... 204/206
4,415,425 11/1983 Schacht ..... 204/206

FOREIGN PATENT DOCUMENTS 0089790 9/1983 European Pat. Off. .

*Primary Examiner*—T. M. Tufariello
*Attorney, Agent, or Firm*—Bacon & Thomas

[57] ABSTRACT

A rotary conductor roll intended to be partially immersed in an electrolyte in a manufacturing line for continuously electroplating a strip (2), the roll includes, on its periphery, at least one electrically conductive active zone (3) and at least one coated zone (41) coated with a flexible material which may optionally be associated with an adhesive and which serves to seal the contact between the strip (2) and the conductive active zone (3) from the electrolyte. At least one intermediate ring (42) is interposed between said conductive active zone (3) and said coated zone (41), said intermediate ring being made of a polymer for which at least one of the following coefficients is intermediate in value between the corresponding coefficients of the material constituting the conductive active zone (3) and of the material constituting said coated zone (41), said coefficients being: coefficient of expansion, flexibility, and swelling due to contact with the electrolyte, e.g. by absorption or by chemical combination.

14 Claims, 3 Drawing Sheets

ROTARY CONDUCTOR ROLL FOR CONTINUOUSLY ELECTROPLATING METAL STRIP OR OTHER ELECTRICALLY CONDUCTIVE STRIP

The present invention relates to the field of surface coating finished and semi-finished metal strip and the like, and it relates in particular to coatings applied to electrically conductive strip, e.g. sheet steel, by electroplating.

BACKGROUND OF THE INVENTION

The invention is intended in particular for the metallurgical industry and more precisely for the circular apparatuses included in electroplating manufacturing lines, e.g. of the continuous electro-galvanizing type. Such apparatuses are referred to as "conductor rolls" and are described, for example, in the following U.S. patents: U.S. Pat. No. 3,483,113 (in particular FIGS. 7, 8, and 9), and U.S. Pat. No. 3,634,223.

These conductor rolls act as cathodes and are generally constituted by at least one electrically conductive cylindrical ring, generally made of stainless steel, mounted on a carbon steel body which is wider than the active zone(s) of the ring(s) via which the electric current passes. The steel body is covered, on either side of the active zone(s) with a flexible polymer substance which is both resilient and insulating, said substance serving, where necessary, to provide drive, and also to provide, sealing, electrical insulation, and protection for the body against corrosion. These rolls are partially immersed in an electrolyte which is generally at a temperature higher than ambient.

The strip is wound around a portion of the conductor roll with its inside face that will not be coated being in contact both with the active zone of the conductive ring in order to establish electrical contact, and also with the resilient insulating substance in order to ensure that the contact device is sealed.

It will readily be understood that if the deposit which is electroplated onto the strip as it passes through the electrolyte is to be uniform, then it is essential for the electrical contact between the ring and the strip to be of uniform good quality, for the sealing at the edges of the strip to be of uniform good quality, and also for the current density to be uniform.

The improvements described to such conductor rolls for electroplating in the above-mentioned U.S. patents are generally directed to ensuring that the electrical conduct is of uniform good quality and also to obtaining proper distribution of current density, both of which factors are very important. As to sealing, the bodies of the conductor rolls are generally covered in rubber, neoprene, or similar material, or else in polyurethane, and emphasis is also made on the necessity of using adhesive which are suitable for such resilient sealing strips, given the essential function they also perform in the method.

Special geometrical dispositions are also sometimes provided at the ends of the conductive rings(s) which may be "hollow", "projecting", or "sawtoothed", for the purpose of attempting to increase the reliability of sealing (see FIGS. 4A, 4B, 4C, 4D, and 4E of U.S. Pat. No. 3,634,223).

Further, in order to be sure that the sealing rings perform both the function of sealing and the function of electrical insulation, they are sometimes mounted on a hard insulating band (see FIG. 7 of U.S. Pat. No. 3,483,113).

However, all of these dispositions do not guarantee that electrical contact and the passage of electrical current between the strip and the conducting ring are completely uniform, nor do they guarantee sealing. In all prior dispositions, (and ignoring a thin interface constituted by adhesive), the resilient sealing band comes directly into contact with the side faces of the active zone(s) of the conductive ring(s). This gives rise to various drawbacks:

Given that elastomers expand much more than steel, the effect of increasing temperature is to increase the radial thickness of the resilient band much faster than the radial thickness of the steel, thereby tending to deteriorate the quality and the uniformity of the physical and electrical contact between the strip and the active zone(s) of the conducting ring(s), in spite of the tractive forces exerted on the strip.

Over a period of time, the resilient elastomer band increases in thickness by virtue of being immersed in the electrolyte due to phenomena of absorption and of chemical combination with the electrolyte (a phenomena which is well known to elastomer professionals), thereby further contributing to deteriorating the quality and the uniformity of physical and electrical contact between the strip and the ring(s).

It will readily be understood that such deterioration in the quality and uniformity of contact is particularly damaging at the side edges of the conducting ring(s) since the elastomer (which expands and swells) comes right up to said edges, while in comparison the metal changes very little. Unfortunately, it is specifically in these zones that it is most difficult to ensure that electrical current diffuses properly since the width of the strip to be coated is greater than the width of the conducting ring(s) and it is desirable for the electroplating current density in the strip to be as uniform as possible.

Even though small, this trend towards becoming unstuck has an immediate and large effect from the standpoint of changing electrical resistance, and thus from the standpoint of plating uniformity and installation efficiency. It is therefore common practice to rework the profiles of these resilient bands, which requires the installation to be stopped and disassembled.

Further, these relative movements between the elastomer and the metal end up by degrading elastomer-to-metal adhesion and thus allowing electrolyte to infiltrate between these two component parts, further deteriorating the uniformity of electric current distribution to some extent, and above all corroding the body of the conductor roll.

The object of the present invention is to considerably reduce these drawbacks while ensuring the vital functions of sealing, electrical insulation,and protection of the roll body against corrosion, and also the optional function of drive. another object of the invention is to improve the coatings applied to strips, to improve the energy efficiency of the installation, and to reduce maintenance costs and the frequency with which the installation needs to be stopped.

SUMMARY OF THE INVENTION

The present invention provides a rotary conductor roll intended to be partially immersed in an electrolyte in a manufacturing line for continuously electroplating a strip, the roll being of the type including, on its periphery, at least one electrically conductive active zone and at least one coated zone coated with a flexible material which may optionally be associated with an adhesive and which serves to seal the contact between the strip and the conductive active zone from the electrolyte, the roll including the improvement whereby at least one intermediate ring is interposed between said conductive active zone and said coated zone, said intermediate ring being made of a polymer for which at least one of the following coefficients of the material constituting the conductive active zone and of the material constituting said coated zone, said coefficients being: coefficient of expansion, flexibility, and swelling due to contact with the electrolyte, e.g. by absorption or by chemical combination.

Thus, according to the invention, the elastomer or flexible polymer or sealing coating together with its adhesive, if any, is not in direct contact with the side edges of the active zone(s) of the conducting ring(s), and one or more polymers, referred to below as "intermediate polymers" are interposed between the elastomer or the flexible polymer or the sealing and the side edges of the active zone(s) of the conducting ring(s), said intermediate polymers being in the form of juxtaposed rings which may partially overlap, and in which all or some of the specified coefficients are intermediate in value between the corresponding very low coefficients for stainless steel (which is the material generally used for the, or each, conducting ring), and the corresponding coefficients of the elastomer or of the flexible polymer or of the sealing. The coefficients in question are coefficient of expansion, flexibility, and aptitude for swelling by absorbing the electrolyte or combining chemically therewith.

For this purpose, it is possible to select, for example, intermediate polymers of the vulcanized natural or nitrile rubber type (commonly called "ebonite" in the profession), or epoxy resins, or any other polymer having a relatively closed cross-linking system which is resistant to acid and has a low coefficient of expansion. The high degree of hardness of such intermediate polymers is no handicap given the special coating shapes provided for by the invention.

In a particular embodiment of the invention, the, or each, intermediate polymer may be reinforced with fibers (suitable substances, for example, being metal fibers, glass fibers, textile fibers, or synthetic fibers) which serve to lock the intermediate polymer(s) radially and limit radial variations in size of this portion of the intermediate polymer coating. If the fibers are electrically conducting fibers, they may also provide a possible advantageous function of causing electrical conductivity to fall off gradually from the edge of the electrically conductive active zone of the corresponding ring.

BRIEF DESCRIPTION OF THE DRAWINGS

Embodiments of the invention are described by way of example with reference to the accompanying drawings, in which.

MORE DETAILED DESCRIPTION

Figure 1:
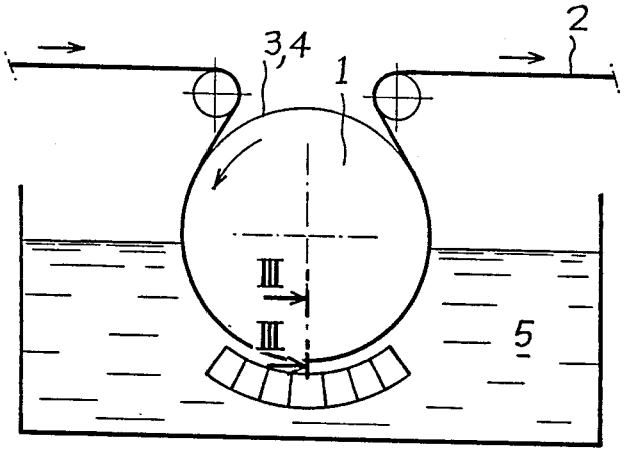
FIGS. 1 and 2 are a side view and a plan view respectively of a prior art roll.
Figure 2:
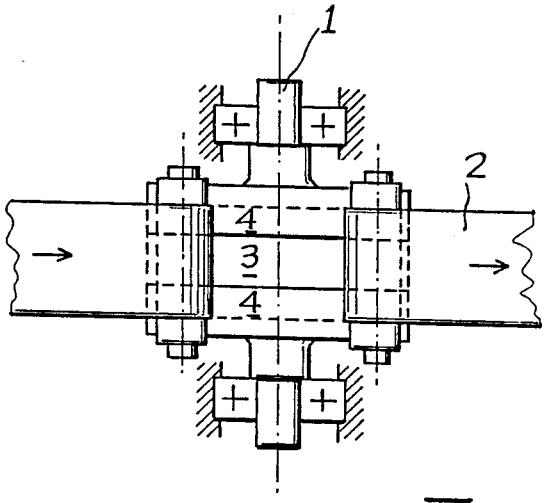

FIG. 1 shows an electroplating rotary roll 1 partially immersed in an electrolyte 5. FIG. 2 shows the active zone 3 of the conducting ring, interposed between zones 4 which are coated with a resilient and insulating substance.

Figure 3:
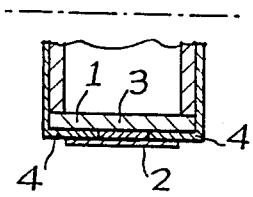
FIG. 3 is a fragmentary cross-section on line III—III of the FIG. 2 roll.

As shown in FIGS. 1 to 3, a strip 2 is wound round a portion of the conductor roll 1, with the face of the strip which in not to be coated during this pass being put into contact with the active zone 3 of the conducting ring in order to make electrical contact, and also coming into contact with the resilient and insulating substance 4 in order to seal the contact device from the electrolyte.

Figure 4:
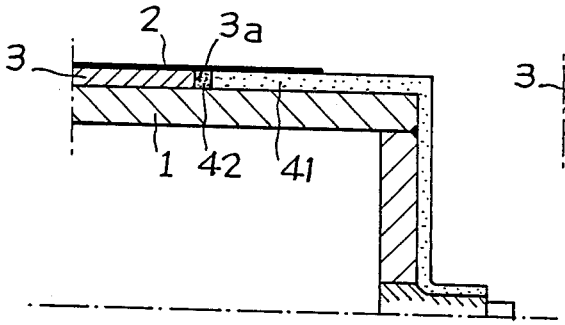
FIG. 4 is a fragmentary cross-section through a conductor roll, a conducting ring, and the insulating coating of a first embodiment of the invention.

As shown in FIG. 4, the resilient and insulating coating in accordance with the invention comprises two different polymers, which are in intimate or sealed lateral contact with each other. The polymer 41 provides the functions of sealing, resilience, drive, and electrical insulation, while the polymer 42, referred to herein as the "intermediate" polymer, is only required to perform the functions of sealing and of electrical insulation. This makes it possible to use a harder polymer therefor, having a cross-linkage structure which is more closed and whose characteristics of expansion or swelling are much more acceptable with respect to the steel than are those of the types of polymer which are suitable for use as the polymer 41.

This intermediate polymer 42 must be perfectly adherized with the end side face 3*a* of the active zone 3 of the conducting ring, and it must naturally be properly adherized with the body 1 and with the polymer 41.

Suitable polymers for the intermediate polymer 42 are defined above. The polymer 41 may be a polyurethane, a Hypalon (from Du Pont de Nemours), or even more advantageously, it may be the compound VARIOLASTIC (from SW Industries, Southborough Technology Park, 333 Turnpike Road, Southborough, Mass. 01773, USA).

It will readily be understood that by virtue of the intermediate polymer, movement or change in dimension of the polymer 41 has much less effect on the quality and the uniformity of electrical contact between the strip 2 and the active face of the conducting ring 3, and that the following are considerably increased: sealing, and thus also uniformity of electrical current distribution at the end of the conductor ring 3; and protection of the body 1 against corrosion. Full scale size tests have demonstrated that the invention is effective compared with conventional solutions and that it very considerably improves the overall yield of an insulation as well as the quality and the uniformity of the plating, and also multiplies by a factor of 3 the time during which a conductor roll can continue to operate between two occasions on which its profile needs to be reworked by rectification, thereby correspondingly reducing the frequency of unavoidable stops.

Good results can already be obtained when the intermediate polymer 42 is not less than 10 mm wide, and the optimum lies between 10 mm and 40 mm depending on the widths of the strip to be processed.

Figure 5:
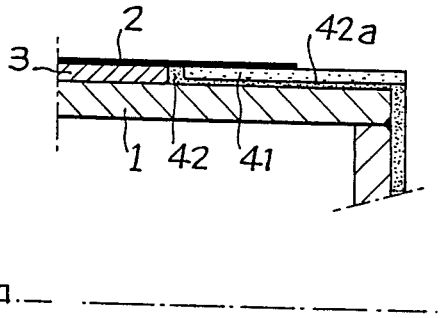
FIGS. 5 to 7 are views similar to FIG. 2 but showing three other embodiments of the insulating coating.

FIG. 5 shows another disposition of the invention in which the polymer 42 is also used as an underlayer 42*a* beneath the polymer 41, thereby improving overall sealing.

Figure 6:
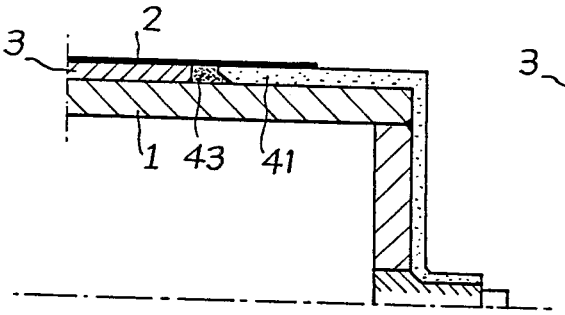

FIG. 6 shows a special shape for the polymer coatings 43 and 41 in that their faces where they meet are inclined so as to cause the transition from one expansion or swelling zone to another to be even more progressive.

Figure 7:
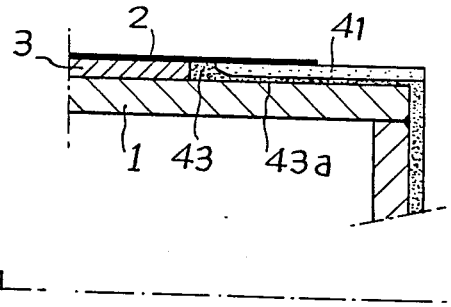

FIG. 7 shows an intermediate polymer 43 combining the features of FIGS. 5 and 6, i.e. the intermediate polymer 43 provides both an underlayer 43*a* and has a sloping face where it meets the polymer 41.

Figure 8:
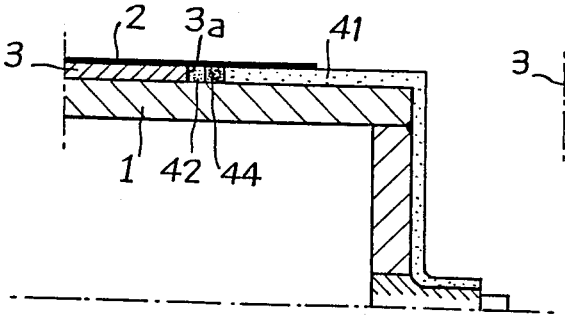
FIGS. 8 and 9 are section views similar to the above but showing coating embodiments including a plurality of intermediate polymers.

In FIG. 8, there are two intermediate polymers 42 and 44, which are selected so as to have physico-chemical characteristics which provide a progressive change between the characteristics of the stainless used for the conducting ring and the characteristics of the resilient and insulating polymer 41.

In a variant of the invention, these polymers 42 and 44 (which are naturally relatively insulating in character) may be doped with conducting substances such as conducting particles in the form of powder or metal fibers or carbon fibers in order to ensure a progressive change in the distribution of electrical current to the strip beyond the edge 3*a* of the conducting ring, thereby avoiding the need to perform difficult machining on the edges of the conducting rings as had previously been used for controlling the distribution of electrical current. In some cases, the flexible or sealing polymer may also be partially doped with electrically conducting substances.

Figure 9:
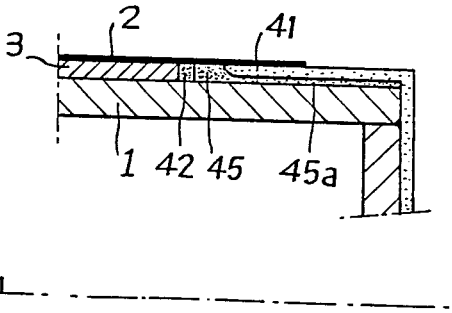

In FIG. 9, the second intermediate polymer 45 also serves as a partial underlayer 45*a* for the polymer 41.

Figure 10:
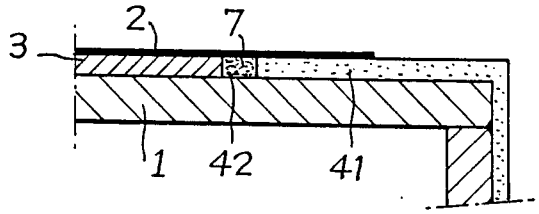
FIG. 10 is a section view similar to FIG. 4 showing an intermediate polymer which is fiber-reinforced.

FIG. 10 shows an intermediate polymer 42 of the type shown in FIG. 2, but reinforced with natural or synthetic fibers 7.

In one embodiment of the invention, insulating fibers may be used, but in another embodiment of the invention, the fibers are chosen to be electrically conductive in order to establish a degree of electrical conductivity in said zone so as to provide better control of the distribution of electricity to the strip.

The reinforcement is highly advantageous firstly for the purpose of providing a mechanical hooping or banding effect, thus limiting radial changes in size, and secondly, when electrically conductive, it serves as a vector for a progressive change in the distribution of electricity.

The reinforced intermediate polymer may also serve as an underlayer as shown in the variants of FIGS. 5 to 7.

In a variant of the invention, all or a portion of an intermediate ring is received beneath an edge flange of the conductive active zone.

Figure 11:
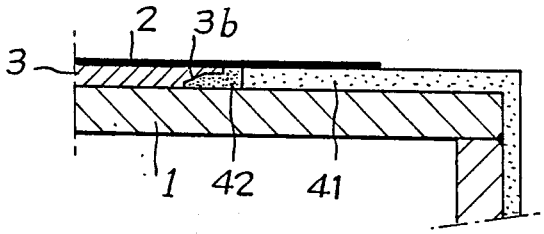
FIGS. 11 to 14 are section views similar to the above figures in which the conducting rings have edges of tapering profile, as described in U.S. Pat. No. 3,634,223.

In FIG. 11, the conducting ring 3 includes an edge 3*b* having a tapering profile as described in U.S. Pat. No. 3,634,223, and the entire "void" beneath the overhanging edge of the ring is filled with intermediate polymer 42. The advantage of having an intermediate polymer 42 which is harder, and more inert than the polymer 41 is even more obvious in this case than in conventional cases since the slightest swelling of the elastomer would otherwise raise the flange of the edge and would immediately deteriorate the quality of the electrical contact between the strip and the conducting ring.

The invention described herein serves to ensure that the outer geometrical generator line of the entire active surface of the conducting ring 3 remains completely rectilinear, with the intermediate polymer 42 ensuring that the edge flanges of the conducting ring are genuinely locked in place.

Figure 12:
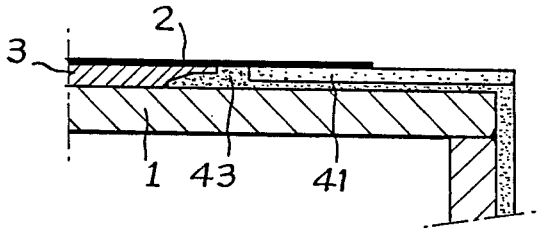
Figure 13:
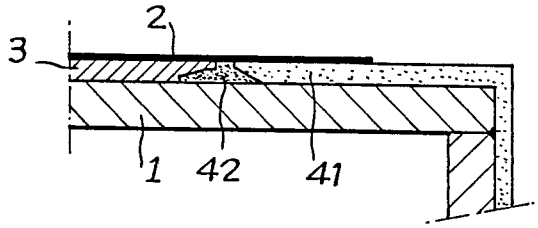
Figure 14:
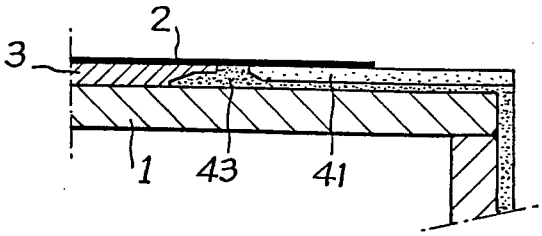

Variants of the invention appear in FIGS. 12 to 14 including an underlayer for the polymer 41 and/or inclined, thus providing progressive contact between the polymers 42 and 41.

Naturally, the present invention is not limited to the embodiments described and shown above merely by way of nonlimiting example, and on the contrary it encompasses all embodiments which implement means that are similar or equivalent.

Thus, for example, the zones occupied by the intermediate polymers may be of any width providing that the contact between the strip and the polymer 41 is sufficient to ensure the functions of sealing, insulation, and elasticity, and optionally the function of drive by adherence. Similarly, the number of intermediate polymers is not limiting.

Further, the various embodiments described above may be combined without thereby going beyond the scope of the invention.

Finally, the invention is particularly applicable to the continuous electro-galvanizing industry, but it is obvious that it can be applied to any industry where a coating is to be applied continuously by electroplating.

We claim:

1. A rotary conductor roll intended to be partially immersed in an electrolyte in a manufacturing line for continuously electroplating a strip, the roll being of the type including, on its periphery, at least one electrically conductive active zone and at least one coated zone coated with a flexible material which serves to seal the contact between the strip and the conductive active zone from the electrolyte, the roll including the improvement whereby at least one intermediate ring is interposed between said conductive active zone and said coated zone, said intermediate ring being made of a polymer for which at least one of the following coefficients in intermediate in value between the corresponding coefficients of the material constituting the conductive active zone and of the material constituting said coated zone, said coefficients being: coefficient of expansion, flexibility, and swelling due to contact with the electrolyte.

2. A roll according to claim 1, including at least two intermediate rings of polymers having different physicochemical properties, with said characteristics of said polymers having values that change progressively from ring to ring between the corresponding values of the conductive active zone and the corresponding values of said coated zone.

3. A roll according to claim 1, wherein the polymer used to constitute the intermediate ring is reinforced with electrically insulating fibers which are natural.

4. A roll according to claim 1, wherein the polymer used for constituting the intermediate ring is reinforced with electrically conductive fibers which are natural.

5. A roll according to claim 1, wherein the polymer used for constituting the intermediate ring is doped with an electrically conductive substance.

6. A roll according to claim 1, wherein the flexible material of said coated zone is doped, in part, with an electrically conductive substance.

7. A roll according to claim 1, wherein the intermediate ring constitutes an underlayer for the material of said coated zone.

8. A roll according to claim 1, wherein at least a portion of an intermediate ring is received beneath an outwardly directed flange of the conductive active zone.

9. A roll according to claim 1, wherein the intermediate ring includes a contact surface which slopes relative to a plane perpendicular to the axis of rotation of the conducting roll.

10. A roll according to claim 1, wherein the flexible material is associated with an adhesive.

11. A roll according to claim 1, wherein the swelling is caused by absorption.

12. A roll according to claim 1, wherein the swelling is caused by chemical combination.

13. A roll according to claim 1, wherein the polymer used to constitute the intermediate ring is reinforced with electrically insulating fibers which are synthetic.

14. A roll according to claim 1, wherein the polymer used for constituting the intermediate ring is reinforced with electrically conductive fibers which are synthetic.

* * * * *